US009070312B2

(12) United States Patent
Aho et al.

(10) Patent No.: US 9,070,312 B2
(45) Date of Patent: Jun. 30, 2015

(54) HYBRID SELF ILLUMINATED AND ACTIVELY BACK LIT SIGNAGE FOR PRINTED GRAPHICS

(71) Applicant: 3M INNOVATIVE PROPERTIES COMPANY, St. Paul, MN (US)

(72) Inventors: Erik A. Aho, North Saint Paul, MN (US); Audrey A. Sherman, Saint Paul, MN (US); Michael A. Meis, Stillwater, MN (US); Kevin R. Schaffer, Woodbury, MN (US); Patrick A. Thomas, Lake Elmo, MN (US); John C. Schultz, Afton, MN (US); Michael H. Hansberry, Minneapolis, MN (US); William J. Bryan, Mahtomedi, MN (US); David A. Harper, Saint Paul, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 71 days.

(21) Appl. No.: 14/072,173

(22) Filed: Nov. 5, 2013

(65) Prior Publication Data

US 2015/0121732 A1 May 7, 2015

(51) Int. Cl.

| | |
|---|---|
| ***G09F 13/18*** | (2006.01) |
| ***G09F 13/14*** | (2006.01) |
| ***G09F 13/04*** | (2006.01) |

(52) U.S. Cl.

CPC ..... *G09F 13/14* (2013.01); *G09F 13/0413* (2013.01); *G09F 2013/0418* (2013.01); *G09F 13/18* (2013.01)

(58) Field of Classification Search

CPC ..... G09F 13/00; G09F 13/02; G09F 13/18

See application file for complete search history.

(56) References Cited

U.S. PATENT DOCUMENTS

| | | | | |
|---|---|---|---|---|
| 1,856,462 | A * | 5/1932 | Burns | 40/562 |
| 4,995,185 | A * | 2/1991 | Cheng | 40/582 |
| 5,759,671 | A * | 6/1998 | Tanaka et al. | 428/166 |
| 6,470,610 | B1 * | 10/2002 | Northey | 40/582 |
| 6,790,578 | B1 * | 9/2004 | Rajan et al. | 430/120.2 |
| 6,791,642 | B1 | 9/2004 | Wang | |
| 7,027,113 | B2 | 4/2006 | Kim | |
| 7,165,959 | B2 | 1/2007 | Humlicek | |
| 7,278,775 | B2 | 10/2007 | Yeo | |

(Continued)

FOREIGN PATENT DOCUMENTS

| | | |
|---|---|---|
| WO | WO 2012-116129 | 8/2012 |
| WO | WO 2012-158414 | 11/2012 |

(Continued)

OTHER PUBLICATIONS

PCT International Search Report for PCT/US2014/061350, mailed Jan. 26, 2015.

(Continued)

*Primary Examiner* — Gary Hoge

(57) ABSTRACT

Hybrid signage capable of self illumination and having an active backlight. The signage includes a turning film having a structured surface for redirecting light in order to passively illuminate a printed graphic or shaped sign when the backlight is off. In the shaped sign, the shape provides the content, such as letters, to be conveyed to the viewer instead of a graphic. The signage can be actively illuminated when the backlight is on to supplemental the passive illumination.

5 Claims, 8 Drawing Sheets

(56) References Cited

U.S. PATENT DOCUMENTS

| | | | | |
|---|---|---|---|---|
| 7,542,635 | B2 | 6/2009 | Coleman | |
| 7,660,509 | B2 | 2/2010 | Bryan | |
| 8,248,554 | B2 | 8/2012 | Qi | |
| 8,848,132 | B2 | 9/2014 | O'Neill | |
| 2002/0018279 | A1 | 2/2002 | Molsen | |
| 2005/0259939 | A1 | 11/2005 | Rinko | |
| 2006/0082699 | A1* | 4/2006 | Gehlsen et al. | 349/61 |
| 2006/0090385 | A1 | 5/2006 | Jurkovic | |
| 2006/0215958 | A1* | 9/2006 | Yeo et al. | 385/31 |
| 2006/0239629 | A1 | 10/2006 | Qi | |
| 2007/0058254 | A1* | 3/2007 | Kim, II | 359/530 |
| 2007/0243844 | A1 | 10/2007 | Cunningham | |
| 2008/0053800 | A1 | 3/2008 | Hoyle | |
| 2010/0141869 | A1 | 6/2010 | Biernathe | |
| 2010/0165660 | A1 | 7/2010 | Weber | |
| 2010/0171929 | A1 | 7/2010 | Liu | |
| 2011/0051396 | A1* | 3/2011 | Liao et al. | 362/97.1 |
| 2011/0116012 | A1* | 5/2011 | Biernath et al. | 349/64 |
| 2011/0122493 | A1 | 5/2011 | Ogawa | |
| 2011/0134623 | A1 | 6/2011 | Sherman | |
| 2011/0176325 | A1 | 7/2011 | Sherman | |
| 2013/0201720 | A1 | 8/2013 | Sherman | |
| 2014/0043846 | A1 | 2/2014 | Yang | |
| 2014/0043847 | A1 | 2/2014 | Yang | |
| 2014/0043850 | A1 | 2/2014 | Thompson | |
| 2014/0043856 | A1 | 2/2014 | Thompson | |
| 2014/0285749 | A1* | 9/2014 | Haag et al. | 349/64 |

FOREIGN PATENT DOCUMENTS

| | | |
|---|---|---|
| WO | WO 2013/184385 | 12/2013 |
| WO | WO 2014/031726 | 2/2014 |

OTHER PUBLICATIONS

Aho, U.S. Appl. No. 13/755,083, "Self Illuminated Signage for Printed Graphics", filed Jan. 31, 2013.

Aho, U.S. Appl. No. 13/875,497, "Self Illuminated Shaped and Two-Sided Signage for Printed Graphics", filed May 2, 2013.

* cited by examiner

HYBRID SELF ILLUMINATED AND ACTIVELY BACK LIT SIGNAGE FOR PRINTED GRAPHICS

BACKGROUND

Printed graphics have been used for advertising, safety, and personal uses for many years. These displays have become so commonplace that it may often be difficult to have a message noticed in a crowd of such signs. One common solution to this occurrence is to actively backlight a digital or static graphic in order to attract more attention. However, this active backlighting can come at a cost of requiring more energy and electronics, and producing more heat in a given environment, all of which may not be desirable. Accordingly, a need exists for ways to illuminate or otherwise draw more attention to static graphic signage.

SUMMARY

A hybrid back lit sign, consistent with the present invention, includes a turning film having a structured surface for redirecting light, a diffuser providing for diffusion in at least one direction, a graphic on the diffuser, and an active backlight. The turning film directs light via the structured surface toward a viewer of the graphic in order to passively illuminate the sign when the active backlight is off.

A hybrid front lit sign, consistent with the present invention, includes a diffuser for providing diffusion in at least one direction, a graphic on the diffuser, a turning film having a structured surface for redirecting light, a reflector on the turning film, and an active backlight. The turning film directs light via the structured surface toward a viewer of the graphic in order to passively illuminate the sign when the active backlight is off.

Another hybrid front lit sign, consistent with the present invention, includes a turning film having a structured surface for redirecting light, a diffuser on the turning film and providing for diffusion in at least one direction, a graphic on the turning film, a reflector on the diffuser, and an active backlight. The turning film directs light via the structured surface toward a viewer of the graphic in order to passively illuminate the sign when the active backlight is off.

The front and back lit signs can be shaped, with or without a graphic, such that the shape provides content to be conveyed to a viewer. The signs can also be two-sided, two signs arranged back-to-back, for providing content on both sides of the sign.

BRIEF DESCRIPTION OF THE DRAWINGS

The accompanying drawings are incorporated in and constitute a part of this specification and, together with the description, explain the advantages and principles of the invention. In the drawings.

DETAILED DESCRIPTION

Embodiments of this invention utilize ambient lighting or remotely located lighting to give a viewer the perception that a graphic has a powered backlight attached to it. In particular, the signage uses a turning film and one or more diffusers providing controlled diffusion in order to direct light toward the viewer of the graphic. This graphic signage can be used in a variety of ways such as with banner applications, advertising, point of purchase signage, traffic signage, or any sort of graphic in which it may be desirable to light the graphic without an active powered backlight. The signage can also be shaped, with or without a graphic, such that the shape provides content to be conveyed to a viewer. The signage also uses an active backlight to illuminate the graphic, providing for hybrid signage that can be passively illuminated or actively back lit. The active backlighting can be used, for example, when insufficient ambient light is available for self illumination or to enhance the self illumination.

Examples of passively lit signs are described in the following, both of which are incorporated herein by reference as if fully set forth: U.S. patent application Ser. No. 13/755,083, entitled "Self Illuminated Signage for Printed Graphics," and filed Jan. 31, 2013; and U.S. patent application Ser. No. 13/875,497, entitled "Self Illuminated Shaped and Two-Sided Signage for Printed Graphics," and filed May 2, 2013.

Hybrid Back Lit Signage

Figure 1:
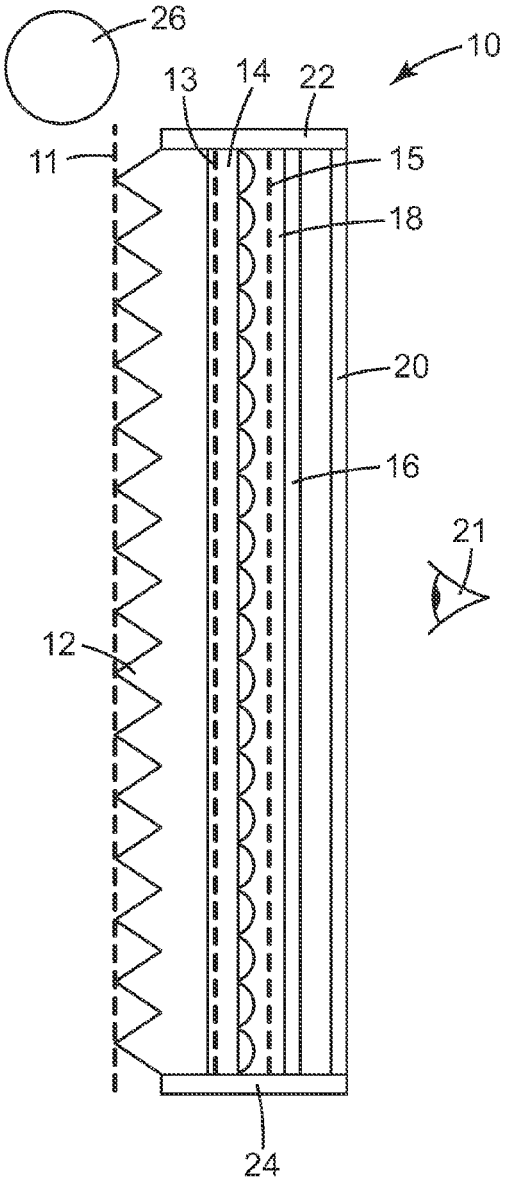
FIG. 1 is a side sectional view of hybrid back lit signage.

FIG. 1 is a side sectional view of hybrid back lit signage 10. Signage 10 includes a turning film 12, a first diffuser 14, a second diffuser 16, and a graphic 20. Signage 10 optionally includes an air gap 18 between diffusers 14 and 16. Alternatively, diffusers 14 and 16 can be in physical contact or, instead of an air gap, can be separated by an optically clear material. The films or components of signage 10 can optionally be held together and edge sealed by tape or frame 22 and 24, which typically surrounds the edges of the films. Graphic 20 can be printed on diffuser 16 or printed on a transparency applied to, for example laminated on, diffuser 16.

Turning film 12 can be implemented with a 60° prism film, for example, or other types of light redirecting films having a structured surface for redirecting light. Diffusers 14 and 16 can be implemented with lenticular diffusing films, for example, with the lenticulars facing toward or away from a viewer of graphic 20. The optional air gap 18 can help prevent damage to the lenticulars when lenticular diffusing films are used for the diffusers. The air gap also provides a refractive index difference. Diffuser 14 provides for diffusion in at least one direction while diffuser 16 provides for diffusion in a different direction. When implemented with a lenticular diffusing film, diffuser 14 preferably has the lenticulars extending in the same direction substantially parallel with the prisms of turning film 12. Preferably, diffusers 14 and 16 provide for diffusion in orthogonal directions, as illustrated in FIG. 1, to provide for better uniformity of illuminating graphic 20. Instead of two diffusers, only one diffuser 14 or 16 can alternatively be used. Also, diffusers 14 and 16 can be replaced by a single asymmetric diffuser. The lenticulars of diffusing film 14 can optionally be registered with the prisms of turning film 12, which can provide for more gain. A system for registering microreplicated features on opposite sides of a film is disclosed in U.S. Pat. No. 7,165,959, which is incorporated herein by reference as if fully set forth.

Figure 2:
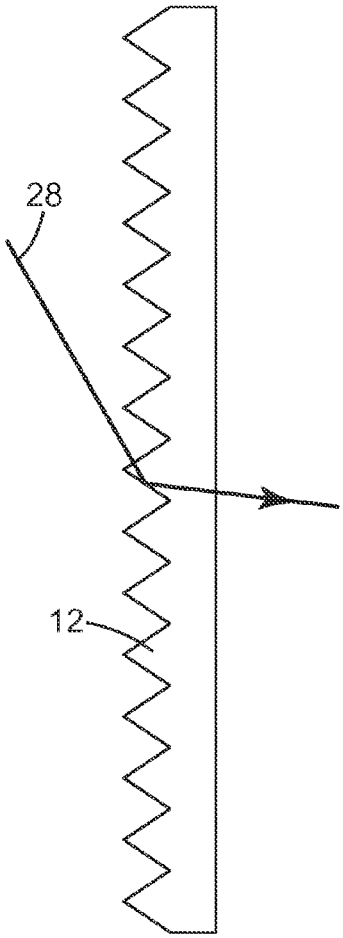
FIG. 2 is a diagram illustrating ray tracing for the signage of FIG. 1.

In use, the features (triangular prisms) in turning film 12 direct light from light source 26, such as a room light, to graphic 20 in order to passively illuminate the signage for a viewer 21. FIG. 2 is a diagram illustrating ray tracing for the signage of FIG. 1, represented by line 28 showing how turning film 12 directs light from room light 26 to graphic 20 and viewer 21 for the passive illumination.

Signage 10 also includes an optional active backlight in order to actively illuminate graphic 20. The active backlight can be incorporated into the signage at various locations. An active backlight 11 can be included behind turning film 12 (from the viewer's perspective), or an active backlight 13 can be included between turning film 12 and diffuser 14, or an active backlight 15 can be included in air gap 18.

Hybrid Front Lit Signage

Figure 3:
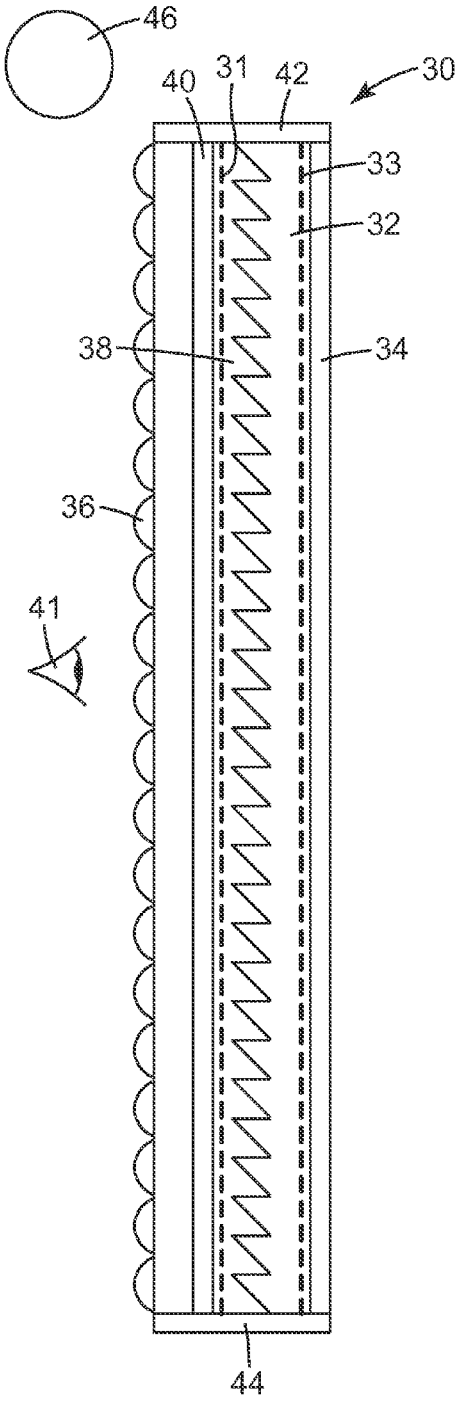
FIG. 3 is a side sectional view of hybrid front lit signage.

FIG. 3 is a side sectional view of hybrid front lit signage 30. Signage 30 includes a turning film 32, a reflector 34, a diffuser 36, and a graphic 40. Signage 30 optionally includes an air gap 38 between turning film 32 and graphic 40. Alternatively, turning film 32 and graphic 40 can be in physical contact or, instead of an air gap, can be separated by an optically clear material. The films or components of signage 30 can optionally be held together and edge sealed by tape or frame 42 and 44, which typically surrounds the edges of the films. Graphic 40 can be printed on diffuser 36 or printed on a transparency applied to, for example laminated on, diffuser 36.

Turning film 32 can be implemented with a sawtooth prism film, for example, or other type s of light redirecting films having a structured surface for redirecting light. For example, a linear Fresnel film can be used instead of a sawtooth prism film. Reflector 34 can be implemented with a specular reflector, for example the Enhanced Specular Reflector (ESR) film from 3M Company. In some cases the specular reflector can be structured so as to provide a limited amount of angular spreading. Specular reflectors with structure include, for example, metalized microstructured films. In some cases the reflector can be semi-specular in nature where the reflector provides a small amount of spreading or limited amount of diffusion for light incident on the reflector. Semi-specular reflectors include, for example, a lightly diffuse coating on ESR film. Diffuser 36 can be implemented with a lenticular diffusing film, for example, with the lenticulars arranged at 45° with respect to the prisms of turning film 32. When implemented with a lenticular diffusing film, the lenticulars can face toward or away from a viewer of graphic 40. Instead of a lenticular diffusing film, diffuser 36 can be implemented with an asymmetric diffuser. The optional air gap 38 can help prevent damage to the prisms of turning film 32. The air gap also provides a refractive index difference.

Figure 5:
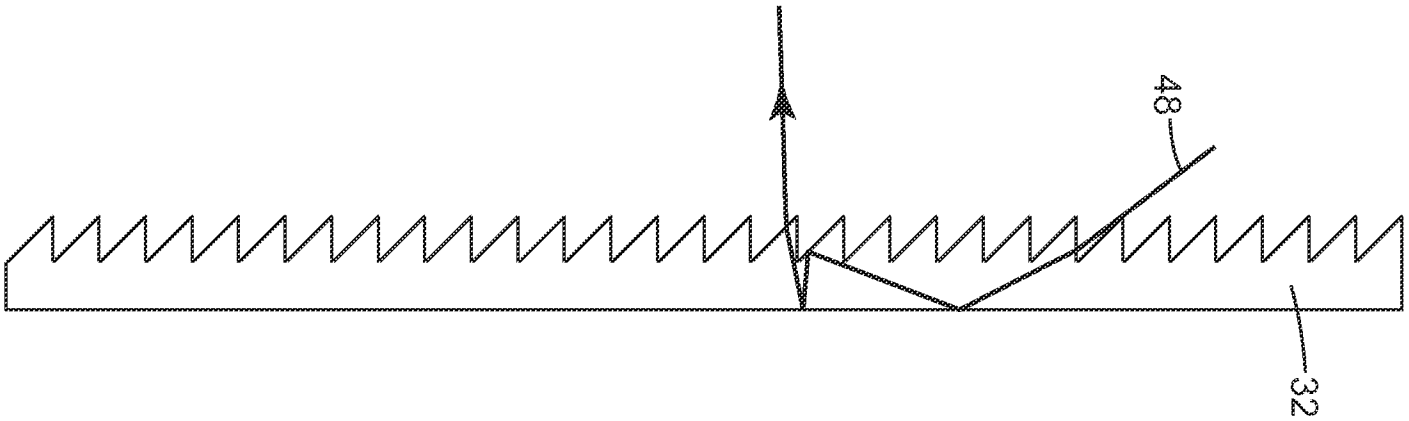
FIG. 5 is a diagram illustrating ray tracing for the signage of FIG. 3.

In use, the features (for example sawtooth prisms) in turning film 32 direct light from light source 46, such as a room light, to graphic 40 in order to passively illuminate the signage for a viewer 41. FIG. 5 is a diagram illustrating ray tracing for the signage of FIG. 3, represented by line 48 showing how turning film 32 directs light from room light 46 to graphic 40 and viewer 41 for the passive illumination.

Signage 30 also includes an optional active backlight in order to actively illuminate graphic 40. The active backlight can be incorporated into the signage at various locations. An active backlight 31 can be included in air gap 38, or an active backlight 33 can be included between turning film 32 and reflector 34.

Figure 4:
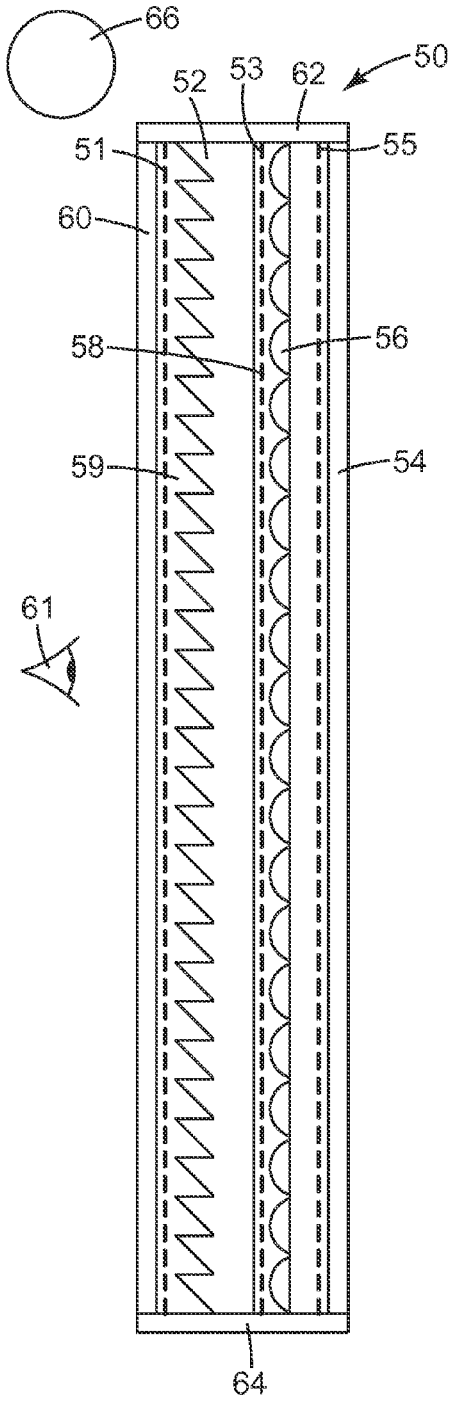
FIG. 4 is a side sectional view of an alternative construction of the signage of FIG. 3.

FIG. 4 is a side sectional view of hybrid front lit signage 50, which is an alternative construction of signage 30. Signage 50 includes a turning film 52, a reflector 54, a diffuser 56, and a graphic 60. Signage 50 can also include an optional air gap 58 between turning film 52 and diffuser 56, and an optional air gap 59 between turning film 52 and graphic 60. An optional edge tape or frame 62 and 64 can be used around the edges of signage 50. In this alternative construction, the diffuser is placed behind the turning film (between the reflector and turning film) with graphic 60 remaining in front of the turning film from the viewer's perspective. In this alternative construction, the diffuser can be attached to the turning film through lamination or a microreplication process with the back side of the diffuser metalized to eliminate the need for a separate reflector. The components of signage 50 can be implemented with the components identified above for signage 30. In use, turning film 52 directs light from a light source 66 to graphic 60 and a viewer 61 in order to passively illuminate the signage.

Signage 50 also includes an optional active backlight in order to actively illuminate graphic 60. The active backlight can be incorporated into the signage at various locations. An active backlight 51 can be included in air gap 59, or an active backlight 53 can be included in air gap 58, or an active backlight 55 can be included between diffuser 56 and reflector 54.

An alternative construction of the front lit sign can include the design described above except the sign can incorporate a curve in the repeated pattern in order to always have the active face of the features largely face the light source when passively illuminated. The center of the radius of curvature of the repeated prism pattern can be such that it largely lies at the projected center of the light source located directly above the sign. This design can produce a single bright spot, indicating that the specular reflections are well controlled. A diffuser can be used to spread the output to a usable width. This construction can be used with a near source as the light source.

Hybrid Shaped Signage

Figure 6:
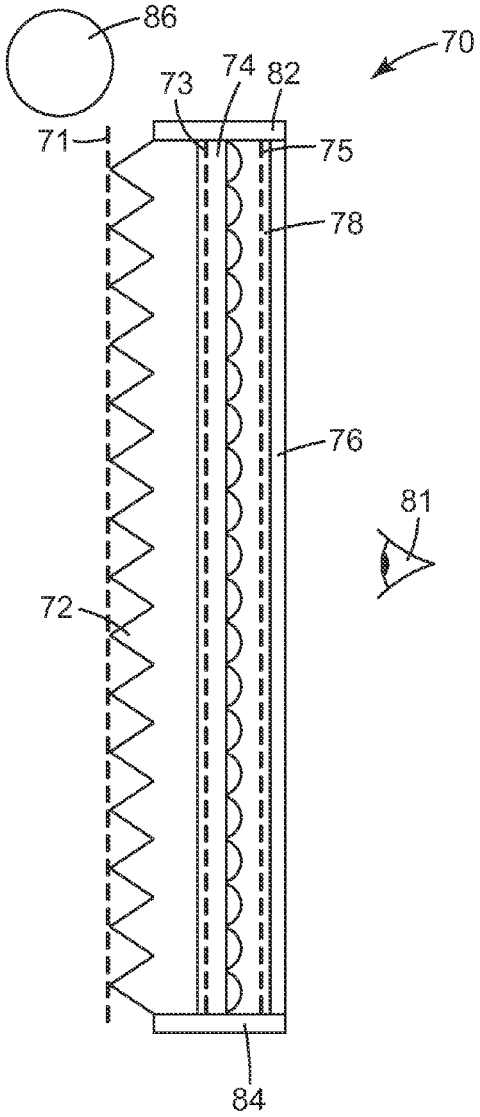
FIG. 6 is a side sectional view of hybrid back lit shaped signage.

FIG. 6 is a side sectional view of hybrid back lit shaped signage 70. Signage 70 includes a turning film 72, a first diffuser 74, and a second diffuser 76. Signage 70 optionally includes an air gap 78 between diffusers 74 and 76. Alternatively, diffusers 74 and 76 can be in physical contact or, instead of an air gap, can be separated by an optically clear material. The films or components of signage 70 can optionally be held together and edge sealed by tape or frame 82 and 84, which typically surrounds the edges of the films.

In use, the features (triangular prisms) in turning film 72 direct light from light source 86, such as a room light, to signage 70 in order to passively illuminate the signage for a viewer 81. Furthermore, a shape of signage 70 from the perspective of viewer 81 provides the content to be conveyed to the viewer.

Signage 70 also includes an optional active backlight to illuminate the shaped signage. The active backlight can be incorporated into the signage at various locations. An active backlight 71 can be included behind turning film 72 (from the viewer's perspective), or an active backlight 73 can be included between turning film 72 and diffuser 74, or an active backlight 75 can be included in air gap 78.

Figure 7:
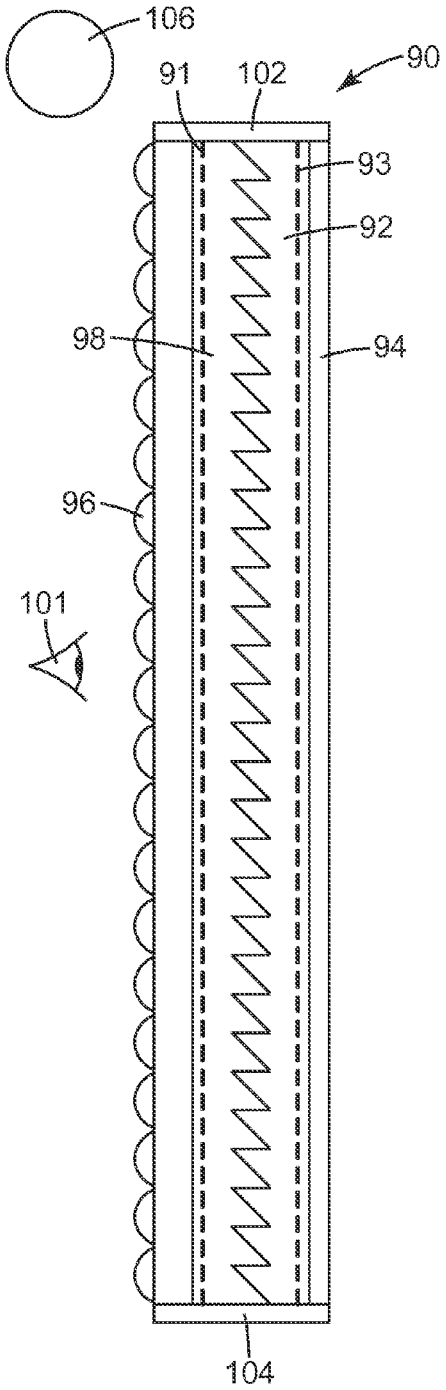
FIG. 7 is a side sectional view of hybrid front lit shaped signage.

FIG. 7 is a side sectional view of hybrid front lit shaped signage 90. Signage 90 includes a turning film 92, a reflector 94, and a diffuser 96. Signage 90 optionally includes an air gap 98 between turning film 92 and diffuser 96. Alternatively, turning film 92 and diffuser 96 can be in physical contact or, instead of an air gap, can be separated by an optically clear material. The films or components of signage 90 can optionally be held together and edge sealed by tape or frame 102 and 104, which typically surrounds the edges of the films.

In use, the features (for example sawtooth prisms) in turning film 92 direct light from light source 106, such as a room light, to signage 90 in order to passively illuminate the signage for a viewer 101. Furthermore, a shape of signage 90 from the perspective of viewer 101 provides the content to be conveyed to the viewer.

Signage 90 also includes an optional active backlight in order to actively illuminate the shaped signage. The active backlight can be incorporated into the signage at various locations. An active backlight 91 can be included in air gap 98, or an active backlight 93 can be included between turning film 92 and reflector 94.

Front lit shaped signage can optionally have the construction of signage 90 except without diffuser 96. In this alternative, the shaped front lit signage has a reflector and turning film, optionally with a frame or edge seal, and operates in a manner similar to signage 90.

The films and components of signage 70 and 90 can be implemented with, for example, the films and components described for signage 10 and 30. Signage 70 and 90 do not have a graphic in that the shape of the signs provides the content to be conveyed. Signage 90 can have the alternative construction of the front lit signage 50 shown in FIG. 4.

Figure 8:
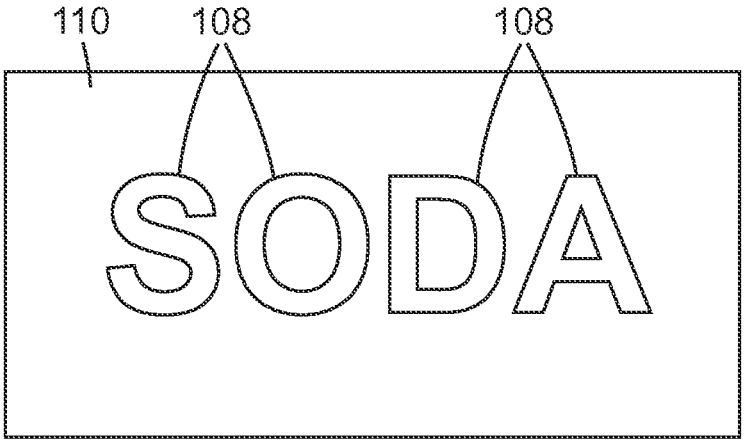
FIG. 8 is a front view of an example of shaped signage without a graphic.

FIG. 8 is a front view of an example of shaped signage without a graphic for signage 70 and 90. In this example, signage 70 or 90 is shaped into the form of letters 108 from the viewer's perspective. Therefore, the shape of the signage provides the content to be conveyed, in this example the word SODA. The shaped signage can optionally be mounted on a film or backing 110. For example, the back lit signage 70 or font lit signage 90 can be mounted on a transparent film or plate for mechanical support. As another example, the front lit signage 90 can be mounted on an opaque film or plate for both mechanical support and to provide contrast for the letters formed by the sign. Film or backing 110 can optionally be implemented with a touch sensor, either clear or not, to incorporate touch sensor capabilities or functionality with the sign. Also, film or backing 110 can optionally be implemented with an active backlight with light extraction elements only in areas 108 of the signage, or an active backlight can be used in the shape of the signage (letters in this example).

Figure 9:
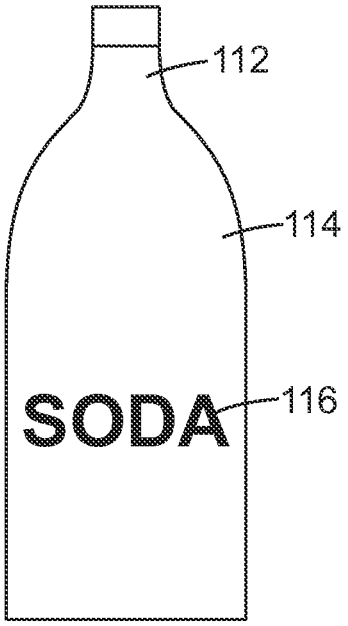
FIG. 9 is a front view of an example of shaped signage with a graphic.

FIG. 9 is a front view of an example of shaped signage with a graphic. Signage 10, 30, and 50 can be shaped from the viewer's perspective. In this example, signage 10, 30, or 50 is shaped into the form of a bottle 112 from the viewer's perspective and also includes a graphic 114 having the word SODA on the graphic. Instead of the generic term soda, graphic 114 can include, for example, the branded name of the soda represented by the bottle shape.

The shaped signage can be made by, for example, laser cutting or die cutting the assembled layers of the signage into one or more desired shapes. The shaped signage can also be placed, for example, on product packaging and have a shape resembling the shape of the packaging. The shapes of the shaped signage can include branded shapes, for example. In addition to the shape providing content, the color of the shaped signage can provide some content, for example branded shapes provided in corresponding branded colors.

Hybrid Two-Sided Signage

Figure 10:
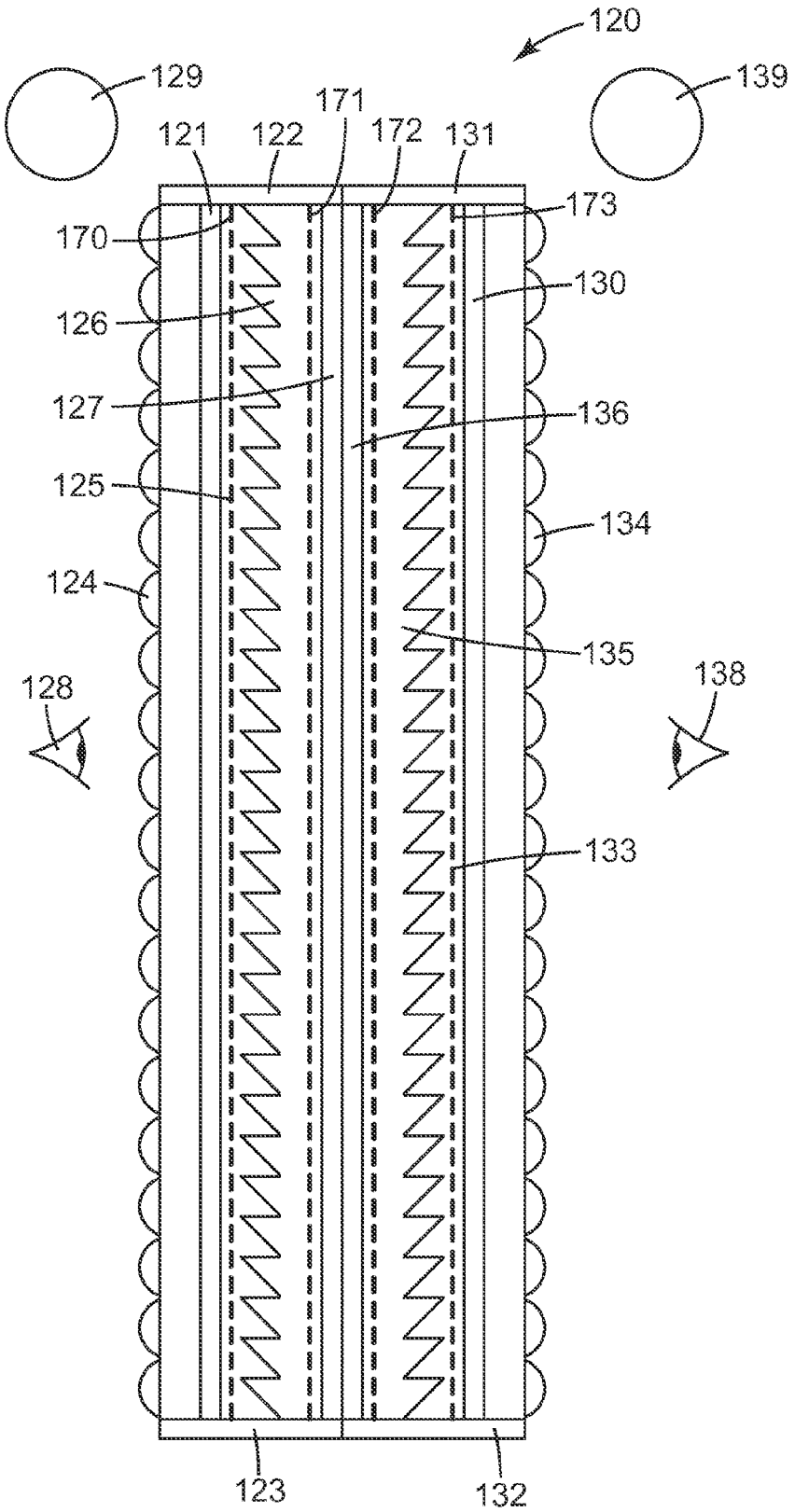
FIG. 10 is a side sectional view of hybrid two-sided signage with two self illuminated front lit signs and active backlighting for both signs.

FIG. 10 is a side sectional view of self illuminated two-sided signage 120 with two front lit signs and active backlighting for both signs. The first sign for signage 120 includes a turning film 126, a reflector 127, a diffuser 124, and a graphic 121. The first sign optionally includes an air gap 125 between turning film 126 and graphic 121. Alternatively, turning film 126 and graphic 121 can be in physical contact or, instead of an air gap, can be separated by an optically clear material. The films or components of the first sign can optionally be held together and edge sealed by tape or frame 122 and 123, which typically surrounds the edges of the films. Graphic 121 can be printed on diffuser 124 or printed on a transparency applied to, for example laminated on, diffuser 124.

The second sign for signage 120 includes a turning film 135, a reflector 136, a diffuser 134, and a graphic 130. The second sign optionally includes an air gap 133 between turning film 135 and graphic 130. Alternatively, turning film 135 and graphic 130 can be in physical contact or, instead of an air gap, can be separated by an optically clear material. The films or components of the second sign can optionally be held together and edge sealed by tape or frame 131 and 132, which typically surrounds the edges of the films. Graphic 130 can be printed on diffuser 134 or printed on a transparency applied to, for example laminated on, diffuser 134.

In use, the features (for example sawtooth prisms) in turning film 126 direct light from light source 129, such as a room light, to graphic 121 in order to passively illuminate the signage for a viewer 128. Also in use, the features (for example sawtooth prisms) in turning film 135 direct light from light source 139, such as a room light, to graphic 130 in order to passively illuminate the signage for a viewer 138.

Signage 120 also includes an optional first active backlight in order to actively illuminate graphic 121 and an optional second active backlight in order to actively illuminate graphic 130. The first and second active backlights can be incorporated into the signage at various locations. For the first active backlight, an active backlight 170 can be included in air gap 125, or an active backlight 171 can be included between turning film 126 and reflector 127. For the second active backlight, an active backlight 172 can be included between turning film 135 and reflector 136, or an active backlight 173 can be included in air gap 133.

The first and second signs for signage 120 can optionally include a common reflector, reflective on both sides, instead of two reflectors 127 and 136. The edge tape or frame 122, 123, 131, and 132 can be combined into a common edge tape or frame for both signs. The first and second signs can be laminated or otherwise adhered together at reflectors 127 and 136, or they can be held together by the edge tape or frame. Signage 120 provides for two front lit signs arranged back-to-back. Signage 120 can optionally be shaped as described in the example of FIG. 9 such that the shape of signage 120 along with graphics 121 and 130 provide the content to be conveyed to the viewers.

Figure 11:
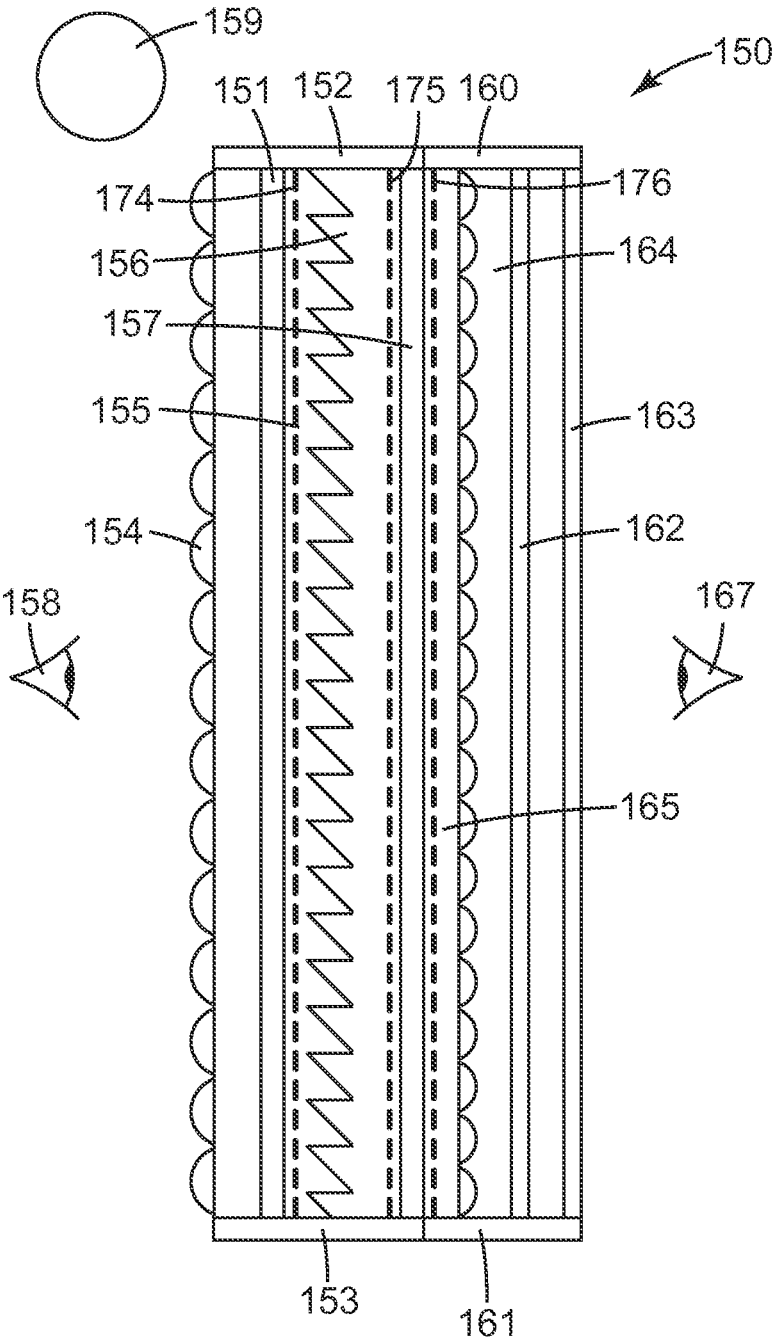
FIG. 11 is a side sectional view of hybrid two-sided signage with self illuminated front lit and back lit signs and active backlighting for both signs.

FIG. 11 is a side sectional view of self illuminated two-sided signage 150 with front lit and back lit signs and active backlighting for both signs. The first sign for signage 150 includes a turning film 156, a reflector 157, a diffuser 154, and a graphic 151. The first sign optionally includes an air gap 155 between turning film 156 and graphic 151. Alternatively, turning film 156 and graphic 151 can be in physical contact or, instead of an air gap, can be separated by an optically clear material. The films or components of the first sign can optionally be held together and edge sealed by tape or frame 152 and 153, which typically surrounds the edges of the films. Graphic 151 can be printed on diffuser 154 or printed on a transparency applied to, for example laminated on, diffuser 154.

The second sign for signage 150 includes a first diffuser 165, a second diffuser 162, and a graphic 163. The second sign optionally includes an air gap 164 between diffusers 165 and 162. Alternatively, diffusers 165 and 162 can be in physical contact or, instead of an air gap, can be separated by an optically clear material. The films or components of the second sign can optionally be held together and edge sealed by tape or frame 160 and 161, which typically surrounds the edges of the films. Graphic 163 can be printed on diffuser 162 or printed on a transparency applied to, for example laminated on, diffuser 162. The second (back lit) sign can optionally include a turning film adjacent diffuser 165, such as the turning film and configuration shown for the back lit sign in FIG. 1.

In use, the features (for example sawtooth prisms) in turning film 156 direct light from light source 159, such as a room light, to graphic 151 in order to passively illuminate the signage for a viewer 158. Also in use, some light from light source 159 is transmitted through the first sign to graphic 163 in order to passively illuminate the signage for a viewer 167. In particular, when reflector 157 is implemented with a partial or half mirror, for example, reflector 157 reflects light from light source 159 for the front lit sign and transmits light from light source 159 for the back lit sign.

Signage 150 also includes an optional first active backlight in order to actively illuminate graphic 151 and an optional second active backlight in order to actively illuminate graphic 163. The first and second active backlights can be incorporated into the signage at various locations. For the first active backlight, an active backlight 174 can be included in air gap 155, or an active backlight 175 can be included between turning film 156 and reflector 157. For the second active backlight, an active backlight 176 can be included between reflector 157 and diffuser 165.

In signage 150, the edge tape or frame 152, 153, 160, and 161 can be combined into a common edge tape or frame for both signs. The first and second signs can be laminated or otherwise adhered together at reflector 157 and diffuser 165, or they can be held together by the edge tape or frame optionally with an air gap between reflector 157 and diffuser 165. Signage 150 provides for a front lit sign and a back lit sign arranged back-to-back. Signage 150 can optionally be shaped as described in the example of FIG. 9 such that the shape of signage 150 along with graphics 151 and 163 provide the content to be conveyed to the viewers.

The films and components for signage 120 and 150 can be implemented with the films and components described for signage 10 and 30. In signage 120 and 150, the front lit signs can have the alternative construction of the front lit signage 50 shown in FIG. 4.

Figure 12:
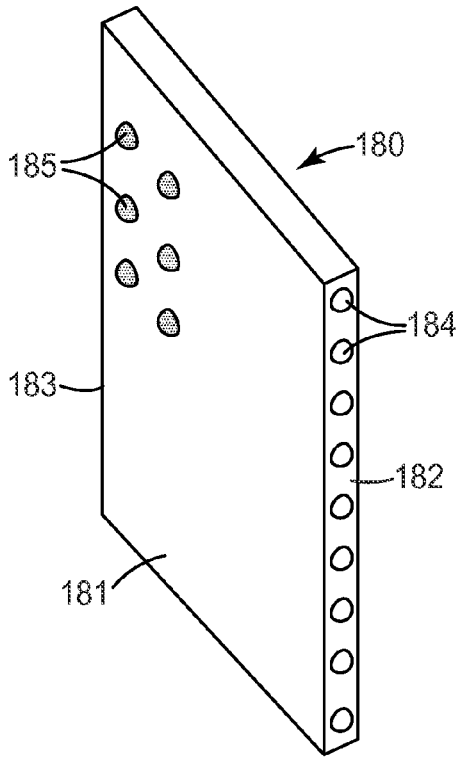
FIG. 12 is a perspective view of an edge lit backlight for hybrid signs.

FIG. 12 is a perspective view of an edge lit backlight 180 for actively backlighting the hybrid signs described above or other such hybrid signs. The signs are hybrid in that they are capable of being passively illuminated when the active backlight is turned off and actively illuminated when the active backlight is turned on. The active backlights are optional in that the signs are capable of self illumination. Backlight 180 can be used to implement the active backlights in the hybrid signs. Backlight 180 includes a light guide having a first edge 182, a second edge 183 opposite first edge 182, and a light emission surface 181 between edges 182 and 183. Light sources 184, such as light emitting diodes (LEDs), are located on edge 182 to provide backlighting via emission surface 181. Light sources can optionally be located on both edges 182 and 183. When an active backlight is used, the light sources would be connected to a power source to be turned on for active backlighting and turned off for passive illumination. Light extraction elements 185, such as printed dots, can optionally be included on light emission surface 181. Light extraction elements 185 can be includes throughout light emission surface 181, on only a portion of light emission surface 181, and arranged in patterns. In the two-sided signage of FIGS. 10 and 11, only one active backlight can optionally be used to illuminate both graphics with light extraction elements on one or both opposing light emission surfaces of the light guide and without a reflector adjacent those surfaces. Examples of edge lit backlights are disclosed in the following, all of which are incorporated herein by reference as if fully set forth: U.S. Patent Application Publication Nos. 2010/0165660, 2011/0134623, 2011/0176325, and 2013/0201720; U.S. Pat. No. 7,660,509; and U.S. patent application Ser. No. 13/984,239, entitled "Front-Lit Reflective Display Device," and filed Sep. 9, 2013.

Figure 13:
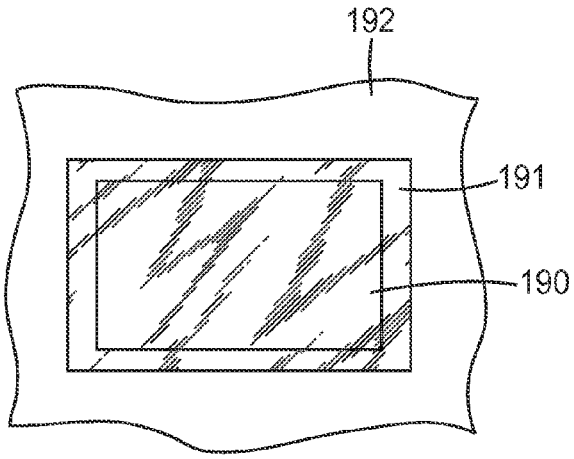
FIG. 13 is a front view of a hybrid or self illuminated sign laminated to a display surface.
Figure 14:
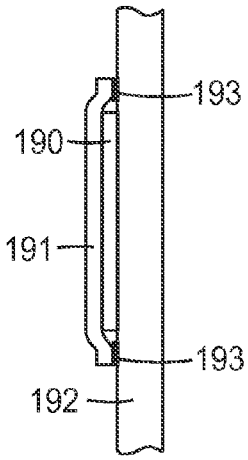
FIG. 14 is a side view of the hybrid or self illuminated sign laminated to the display surface.

FIGS. 13 and 14 are front and side views, respectively, of a hybrid or self illuminated sign laminated to a display surface. In particular, signage 190 has a transparent cover sheet 191 laminating signage 190 to a display surface 192. Cover sheet 191 can be implemented with an over-laminate slightly larger than signage 190 and secured to display surface 192 with an adhesive 193 surrounding signage 190 between an outer perimeter of cover sheet 191 and display surface 192. Cover sheet 191 as an over-laminate can hold the components of signage 190 in place on display surface 192 and seal (encapsulate) signage 190 from the environment. The over-laminate can be used to permanently secure the sign to a display surface or secure it in such a way the sign can be removed from the display surface and repositioned. Signage 190 can correspond with any of the hybrid signage or self illuminated signage (not having an active backlight) described herein. Cover sheet 191 can implemented with a transparent flexible film. Adhesive 193 can be implemented with an optically clear adhesive (OCA) such as the 3M 8172 OCA product (3M Company, St. Paul, Minn.).

Display surface 192 can correspond with a window, glass pane, acrylic sheet, or any other transparent material, in which case signage 190 can be installed for viewing from either side of display surface 192. Alternatively, display surface 192 can be an opaque surface, such as a wall, for installation of signage 190 as a front lit sign. As another alternative, display surface 192 can be implemented with a portable surface, such as piece of glass or acrylic, which can be subsequently mounted to another surface. Display surface 192 can optionally be implemented with a touch sensor, either clear or not, to incorporate touch sensor capabilities or functionality with the sign, or a touch sensor can be included on display surface 192 underneath the sign. The over-laminate cover sheet 191 can also optionally be implemented with a clear touch sensor. Using a touch sensor with the signs can provide, for example, a way for a viewer to interact with the signs.

Figure 15:
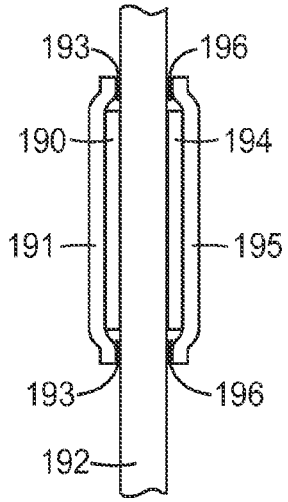
FIG. 15 is a side view of an alternative construction of the signage of FIG. 14 with the sign laminated to both sides of the display surface.

FIG. 15 is a side view of an alternative construction of the signage of FIG. 14 with the sign laminated to two opposing display surfaces. If display surface 192 is a transparent surface, such as a window, the signage can be secured to two display surfaces. In particular, signage 190 can include some components of the complete sign, while signage 194 contains other components of the sign. Signage 194 is secured to a surface opposite display surface 192 with a cover sheet 195 laminated to the opposite surface with an adhesive 196 on the perimeter of cover sheet 195. In this case, signage 190 and signage 194 collectively provide a complete front or back lit hybrid or self illuminated sign that can possibly be viewed from either display surface. As an example, a graphic and diffuser can be provided on one display surface while a turning film and reflector are provided on an opposing display surface for a self illuminated front lit sign. The components of the signs can be separated in other ways between the opposing display surfaces. Alternatively, some components of the sign can be secured to the display surface with an over-laminate while other components of the sign are provided on an opposite display surface without an over-laminate. Cover sheets 191 and 195 in this embodiment can optionally be implemented with clear touch sensors.

The use of cover sheet 191 as an over-laminate can provide for a convenient way to install signage 190. For example, first only the front assembly of the signage with the cover sheet is adhered to a glass surface at the bottom of the cover sheet or assembly. Only attaching the bottom of the cover sheet first allows for easy visual alignment and insertion of the back assembly. The front assembly is allowed to fold down, and the back assembly is held temporarily in place on the glass surface. Once the back assembly is in place, the remaining edge adhesive on the cover sheet can be exposed and the front assembly folded into place and secured to the glass surface with the graphic lying flat.

For the signage described above, the remotely located or ambient light may be oriented either in front of or behind the graphic and possibly at a high angle depending on the specific signage design. The light sources for passively illuminating the signage are shown proximate the signs for illustrative purposes only; the light sources can be located at a variety of positions and distances in front of the sign for front lit signs or behind the signs for back lit signs, including positioned at various angles with respect to the signs. Aside from or in addition to room lighting, the light source for passive illumination can include sunlight from a window, for example. The light source can also include a large area collimated light source.

For the signage, when a film or component is recited as being on another film or component, the film or component can be directly on (in physical contact with) the other film or component, adjacent but not in physical contact with the other film or component, or partially directly on and partially adjacent the other film or component.

The signage including the graphic can be substantially planar, as shown, or optionally curved. For curved signage, the optional frame can be curved to hold the films of the signage in a curved arrangement. The graphic for the sign can include, for example, text, logos, drawings, images, branded shapes, photos, or any other static information. The static information can be provided as a print on any type of substantially transparent and substantially non-diffusing substrate, for example polymeric films or transparent inorganic glass. In some embodiments the static information can comprise a solid color surface, which can optionally also be a structured surface. In some embodiments the static information can comprise a multi-color surface, which can optionally also be a structured surface. The information for the graphic is contained on the signage and is not projected onto it. However, the self illumination of the signage may provide the appearance of a projected image due to the lighting of the graphic. Also, depending upon the types of diffuser or other films used in the signage, the graphic may have the appearance of a 3D or floating image.

For any of the signage, the frame holding the components together can include a shelf edge label frame. With such a frame, the graphic can optionally be removable from the shelf edge label and replaced with a different graphic using the same diffusers and turning films. For example, a store can provide the shelf edge label without the graphic, and a customer or vendor can then provide the graphic or the graphic laminated to the diffuser to be included in the shelf edge label frame. In this example, the graphic is removable from the diffuser or the turning film, depending upon whether the graphic or graphic and diffuser combination is provided.

When the signage is used in multiple shelf edge labels at varying shelf heights, the signs can be tuned to the lighting environment to optimize the self illumination for different viewing angles based upon the sign position. For example, a combination of three shelf edge label self illuminated signs at varying heights can be provided and tuned for viewing from three angles for the viewer looking directly at a shelf edge label, down at a shelf edge label, and up at a shelf edge label.

Aside from shelf edge labels, other self illuminated signs can also be tuned to lighting environments to optimize or provide a desired appearance based upon a position of the signs within the lighting environments.

The front lit signage, whether shaped or not, can optionally include a static sign or graphic on the back side opposite the side with the illuminated graphic.

The front and back lit signage, whether shape or not, can optionally include a partial mirror over the turning film such that the signage is self illuminated and includes some reflectivity from the viewer side.

The invention claimed is:

1. A hybrid front lit sign, comprising:

a diffuser for providing diffusion in at least one direction;

a graphic on the diffuser;

a turning film having a first structured surface for redirecting light and a second surface opposite the first surface, wherein the turning film is on a side of the graphic opposite the diffuser and the first structured surface faces the graphic;

a reflector on the second surface of the turning film; and an active backlight for actively backlighting the sign, wherein the turning film directs light via the first structured surface from in front of the sign toward a viewer of the graphic in order to passively illuminate the sign when the active backlight is off.

2. The sign of claim 1, further comprising an over-laminate securing the sign to a display surface.

3. A hybrid front lit shaped sign, comprising:

a turning film having a first structured surface for redirecting light and a second surface opposite the first surface;

a reflector on the second surface of the turning film; and an active backlight for actively backlighting the sign, wherein the turning film directs light via the first structured surface from in front of the sign toward a viewer of the sign in order to passively illuminate the sign when the active backlight is off, wherein a shape of the sign from the viewer's perspective provides content to be conveyed to the viewer.

4. The sign of claim 3, further comprising an over-laminate securing the sign to a display surface.

5. The sign of claim 3, wherein the shape of the sign comprises one or more letters.

* * * * *